United States Patent [19]

Russell

[11] Patent Number: 4,457,153

[45] Date of Patent: Jul. 3, 1984

[54] METHOD AND APPARATUS FOR FORMING INTERNAL THREADS IN TUBES

[75] Inventor: John X. Russell, Troy, Mich.

[73] Assignee: Apex Corporation, Roseville, Mich.

[21] Appl. No.: 363,316

[22] Filed: Mar. 29, 1982

[51] Int. Cl.[3] ..... B21H 3/08

[52] U.S. Cl. ..... 72/125; 10/107 PH; 10/129 WH; 10/130 WH; 72/316; 414/748

[58] Field of Search ..... 72/115, 117, 118, 120, 72/125, 316, 422, 424; 10/129 R, 129 WH, 130 R, 130 WH, 139 R, 139 WH, 107 PH; 408/69, 70, 45, 53, 49, 104, 105, 106, 107; 414/748; 198/372, 436

[56] References Cited

U.S. PATENT DOCUMENTS

| | | | |
|---|---|---|---|
| 899,915 | 9/1908 | Smith | 408/69 |
| 2,704,848 | 3/1955 | Straty | 408/106 |
| 3,056,983 | 10/1962 | Devereux et al. | 10/139 R |
| 3,246,733 | 4/1966 | Torbet et al. | 198/372 |
| 4,314,471 | 2/1982 | Lukach | 72/422 |

*Primary Examiner*—Lowell A. Larson
*Attorney, Agent, or Firm*—Krass and Young

[57] ABSTRACT

A method and apparatus for forming internal threads on tubular components by a non-cutting process is disclosed. Various disclosed features find particular utility when using a thread forming or rolling tap process to form internal threads on sucker rod coupling tubes. In the preferred embodiment, a machine is disclosed utilizing a movable fixture head (34) capable of simultaneously threading one or more tubes (12, 12') of various sizes. A single hydraulic cylinder (59) moves the fixture head to various positions relative to the work stations (14, 16) to control several operational steps including the sequential feed of the tubes (12) to the work stations (14, 16), clamping/unclamping of the tubes during the tapping process, and retention of the tap (204) while the threaded tubes are removed from the work stations.

16 Claims, 14 Drawing Figures

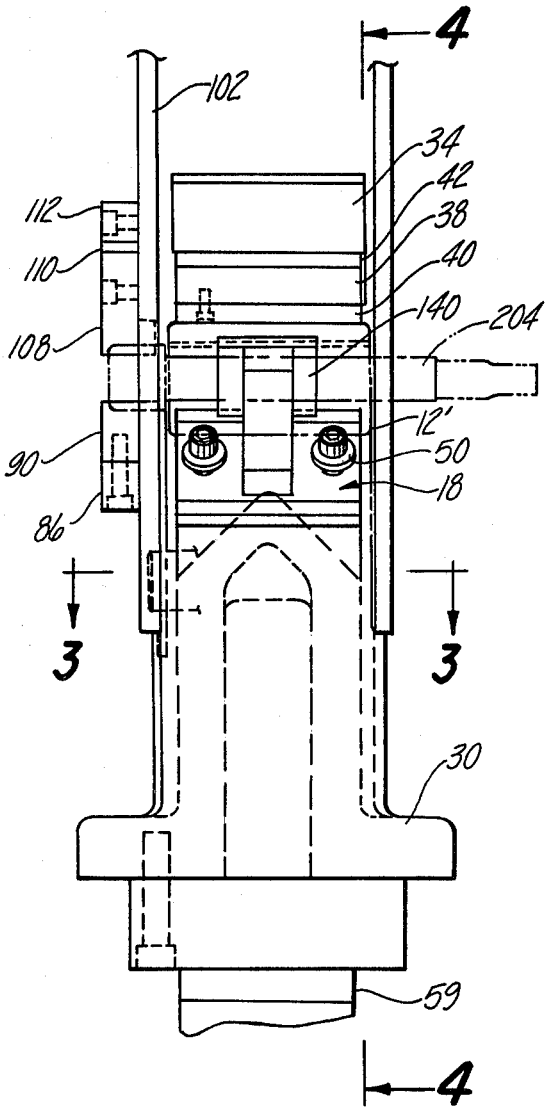
Fig-2
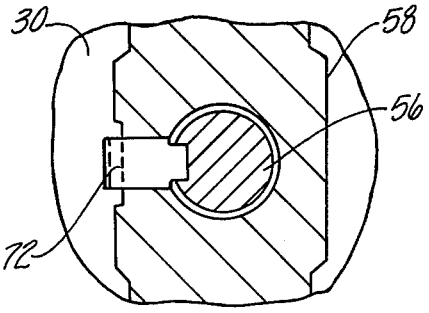
Fig-3
Fig-5
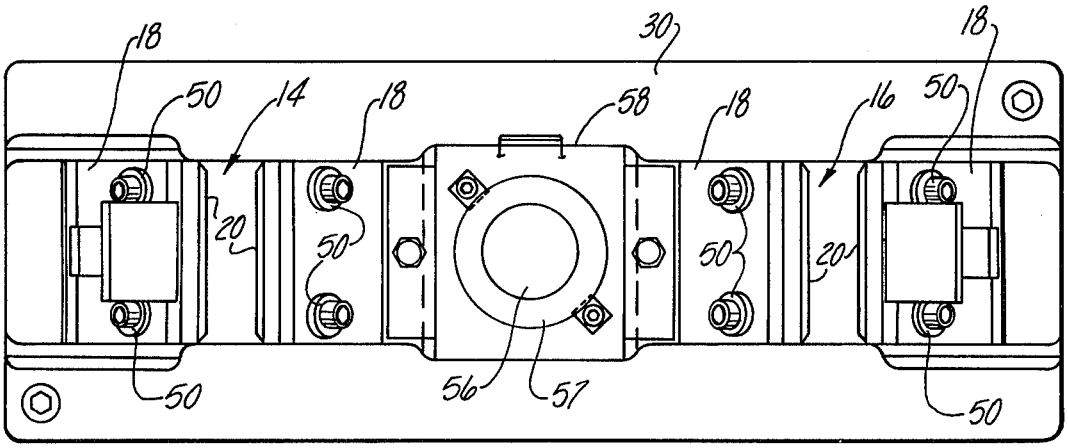

102
34
98
42
36
38
40
108
12
200
204
212
210
208
206
202
92
88
14
214
207

36
204
214
12

36
208
206
204
214
12

98
36
208
206
204
12
92
88
214

36
98
12
204
88
214

98
36
208
206
204
88
214

METHOD AND APPARATUS FOR FORMING INTERNAL THREADS IN TUBES

TECHNICAL FIELD

This invention relates to part threading machines and, more particularly, to techniques for forming internal threads in tubular components by a non-cutting process.

BACKGROUND ART

In a conventional thread cutting process the workpiece is held in place while a cutting tap is passed through the workpiece to form the threads and then the tap is backed out of the workpiece in the reverse direction. This type of process is normally used for creating threads in many fastener products.

However, there are several instances where internal threads cannot be created on components by the usual thread cutting process. For example, the American Petroleum Institute has prescribed standards for making sucker rod coupling tubes that do not permit the internal threads to be created by a cutting process. These sucker rod couplings are short lengths of internally threaded tubes used for connecting together components of longer lengths.

A thread forming or rolling tap method has been used to form the internal threads on these sucker rod couplings. The thread forming process is similar to swaging where a tap is used to compress the inner surfaces of the tube to form the threads. In contrast to the conventional cutting process, the tap cannot be backed out of the tube once the threads have been made during the initial forward pass. The prohibition against backing the tap out of the part is due in large part to the desire to prolong the life of the precision tap.

While admittedly increasing the tool life the inability to back the tap out of the part does complicate the operational steps necessary to complete the process. After the tap initially passes through the part the tap must be released from its tool holder and the workpiece must be separated from the tap. Many of the sucker rod coupling tubes now in use have been made by a substantially manual process in which workmen physically grasp the end of the tap protruding from the part and pull the rest of the tap completely through the workpiece.

Some effort has been made to automate this process. In one known machine each tube is horizontally fed in an end-to-end fashion into a work station having a set of V-shaped jaws for clamping each tube during the thread forming process. Separate drive cylinders are used to independently control the feed of the parts to the work station, the clamping of the workpieces, and the clamping of the tap while the threaded part is slid rearwardly over the shank of the tap.

Machines of this type have serious drawbacks. They are designed to tap only one part at a time yet they require a multitude of separate drive cylinders which must operate in properly timed relationship. They do not have the capability of readily adapting themselves to new part sizes without requiring a major change. The feeding of the parts into the work station requires that the tubes be oriented in an end-to-end relationship. Such an orientation requirement may unduly increase the complexity and cost of the conveyor equipment necessary to transport the tubes to the threading work station.

The present invention is directed to solving one or more of these problems.

DISCLOSURE OF THE INVENTION

In one aspect of this invention a movable fixture head carries both a tube clamp member and a tap clamp member for clamping the tube and tap, respectively, at various positions of the head relative to a work station which supports the tube during the threading operation. Preferably, the unthreaded tubes are stacked in a vertical chute having an outlet of a given size emptying into the work station. A portion of the head is positioned adjacent to the outlet to selectively control the sequential feeding of the tubes into the work station as a function of the position of the head. A single power source for moving the head may be employed to control at least three distinct operations: the feeding of the tubes into the work station, the clamping of the tubes during the threading operation, and the clamping of the tap during removal of the threaded tube.

Another feature of the present invention includes the use of a stripper finger for removing the threaded tube from the work station upon retraction of the tapping unit after the tap has been disconnected from the unit. Provision may also be made for releasing the tap from the tapping unit as a result of movement of the fixture head.

The present invention is ideally suited for simultaneously threading two or more tubes of different sizes. The machine system of the preferred embodiment employs a single fixture defining dual work stations for supporting tubes fed from two vertical chutes. Easily removable spacers in each of the work stations are used to define an appropriately sized gripping area for the part clamping members. A reciprocating rocker arm mechanism controlled by the movement of the head may be employed to alternately feed unthreaded tubes from a conveyor into each of the two chutes.

According to the method of the present invention the unthreaded tubes are stacked in a vertical chute having an outlet of a given size emptying into a work station for supporting the tubes. The fixture head is moved upwardly to an open position to allow one of the tubes to roll into the work station. The head is then moved downwardly to contact the tube to hold it securely while a tapping unit is advanced to form an internal thread in the tube. The tap is disconnected from the unit and the head moved upwardly to clamp the end of the tap protruding from the tube between a fixed upper tap clamp and a lower tap clamp carried by the head. A stripper finger connected to the tapping unit operates to pull the threaded tube from the work station when the tapping unit is retracted. The tapping unit is then readvanced to retrieve the tap. The head is moved downwardly to a position sufficient to unclamp the end of the tap but not so far as to impede removal of the tap from the station. The unit is retracted to remove the tap from the station and the head is moved upwardly to the open position to allow the next tube to roll into the work station for threading.

BRIEF DESCRIPTION OF THE DRAWINGS

Various other features of this invention will become apparent to one skilled in the art upon reading the following specification and by reference to the drawings in which:

FIG. 2 is a side elevation view of the fixture;

FIG. 3 is a partial cross sectional view along the lines 3—3 of FIG. 2;

FIG. 5 is a top view of the fixed lower portion of the fixture taken along the lines 5—5 of FIG. 4;

DESCRIPTION OF THE PREFERRED EMBODIMENT

Figure 1:
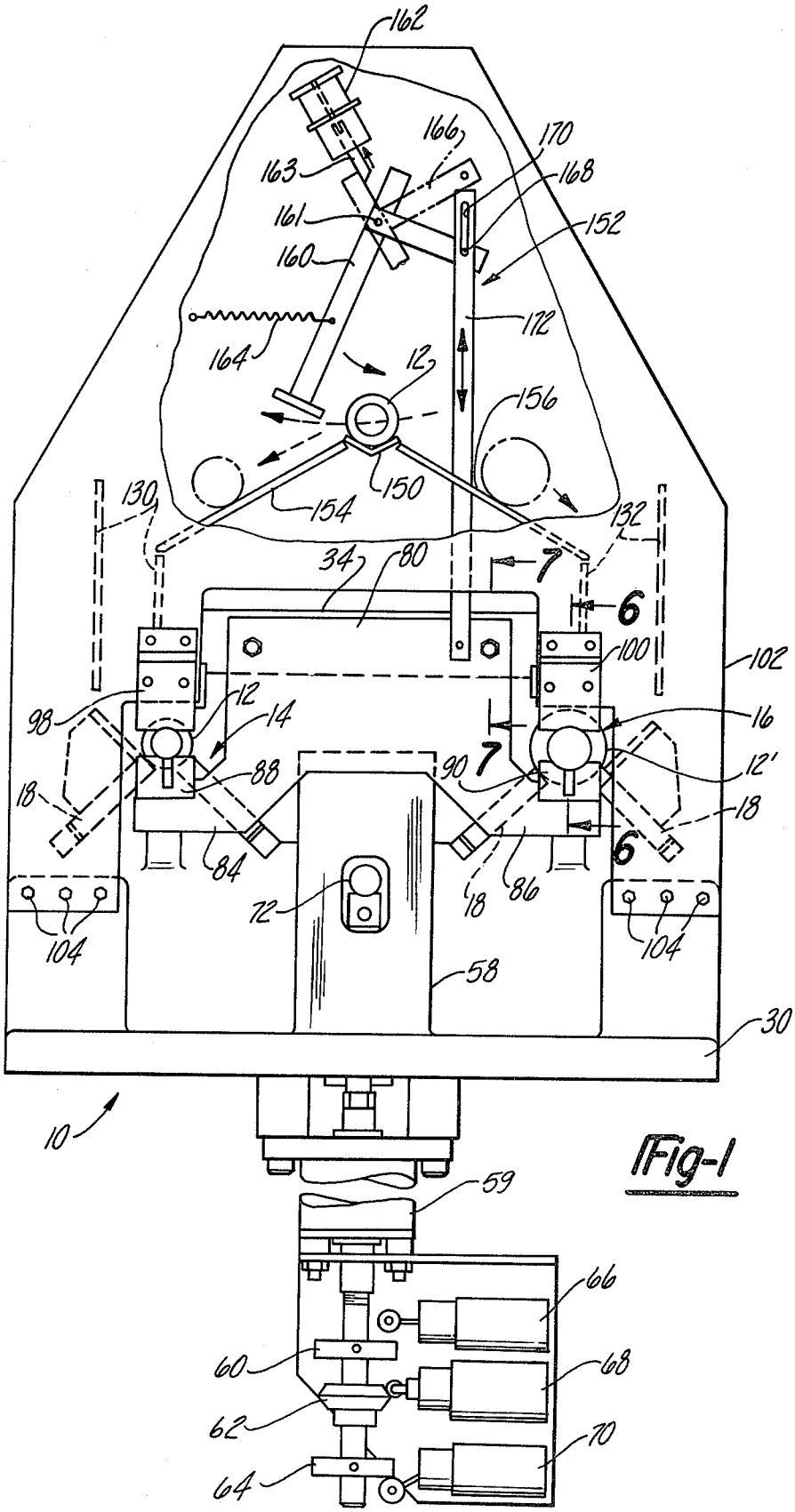
FIG. 1 is a front elevation view with portions cut away of the fixture of the preferred embodiment of this invention.

Turning now to the drawings, the fixture 10 finds particular utility for forming internal threads in hollow tubes 12 and 12' to be used as sucker rod coupling tubes. Accordingly, the preferred embodiment of this invention will be described in relationship to the use of the fixture as part of a sucker rod coupling threading machine system. However, those skilled in the the art will come to appreciate that the present invention may find use as a machine for threading other types of tubes by non-cutting processes.

With this caveat in mind, fixture 10 in the preferred embodiment has two work stations designated by the numerals 14 and 16 for simultaneously threading two tubes 12 and 12', respectively. The components making up work stations 14 and 16 are substantially the same except for the dimension of adjustment devices used to define the workpiece gripping area for each of the work stations. In such manner, the work stations are adapted to accept tubes of different outer diameters with but minor modifications. To this end each work station includes two contact members for supporting the lower portions of the workpiece. The contact members are substantially identical and thus, bear the same reference numeral 18. Contact members 18 advantageously employ precision ground locating surfaces 20 for contacting the workpiece. Surfaces 20 are formed in the ends of generally rectangular plates 22 having elongated mounting slots 24 therein (See FIG. 14 in particular). Precision ground spacer blocks 26 are disposed between an opposite end of plates 22 and an inclined surface 28 of fixture base 30. As can be seen most clearly in FIG. 4, spacers 26 are removably secured to plates 22 by way of suitable retaining means such as dowels 32.

The upper locating surface for each of the work stations 14 and 16 is provided by movable head 34 with its two upper contact members 36. Contact members 36 employ the same general scheme as the lower contact members 18 to adjust for the proper gripping area. Upper contact members 36 employ inserts 38 with projecting abutment surfaces 40. The extent of the projection of abutment surface 40 into the work station is determined by the thickness of spacer 42 which is sandwiched between surface 44 in head 34 by way of bolt 46 (see, especially FIGS. 4 and 14). Thus, it can be appreciated that the gripping area for each of the work stations may be readily modified merely by using spacers 26 and 42 of the desired thickness. The elongated slots 24 in the lower contact members 18 allow for vertical movement thereof with respect to mounting bolts 50.

Head 34 takes the form of a horizontally oriented bar having opposing arm portions 52, 54 for each work station. Head 34 is vertically movable to various preset locations relative to the work stations. The vertical movement of head 34 is accomplished by way of a single shaft 56 which passes through a bushing 57 in central upstanding casing 58 in base 30. The upper portion of shaft 56 is suitably connected to the middle lower portion of head 34 as can be seen most clearly in FIG. 4. As shown in FIG. 1, the lower portion of shaft 56 is connected to a cylinder 59 which includes three switch dogs 60, 62 and 64 serving to engage limit switches 66, 68 and 70, respectively, during the vertical movement of cylinder 59. FIG. 3 illustrates the use of a guide 72 slidably engaging a vertical keyway 73 in frontal portions of shaft 56 to thereby restrict rotational movement of shaft 56. Cylinder 59 may be driven by conventional hydraulic or pneumatic power sources. As will become apparent later on, one of the most advantageous features of this invention is the fact that it only requires one such power source, yet the fixture performs several different functions.

Figure 7:
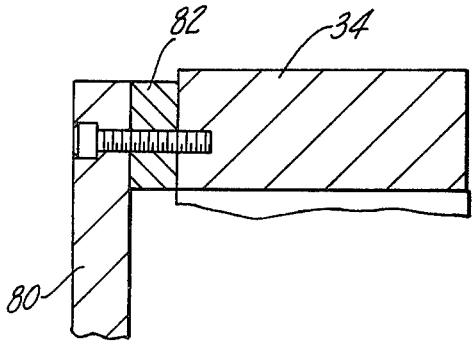
FIG. 7 is a partial cross-sectional view taken along the lines 7—7 of FIG. 1.
Figure 12:
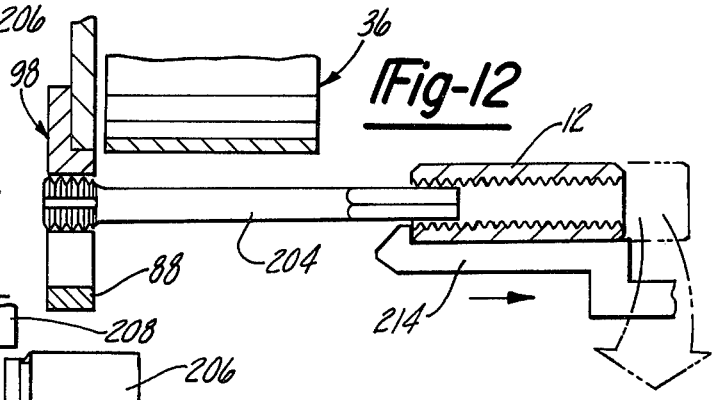
Figure 13:
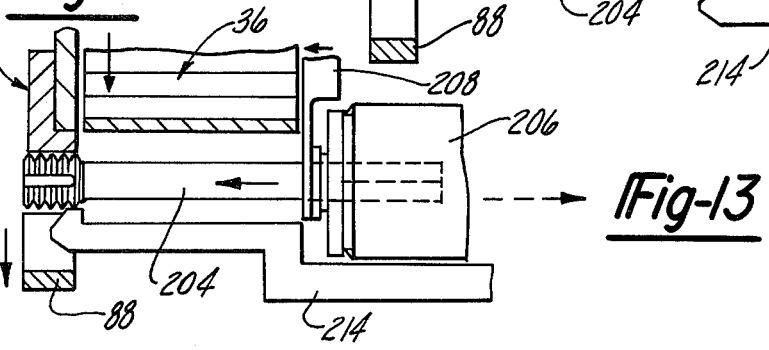
Figure 14:
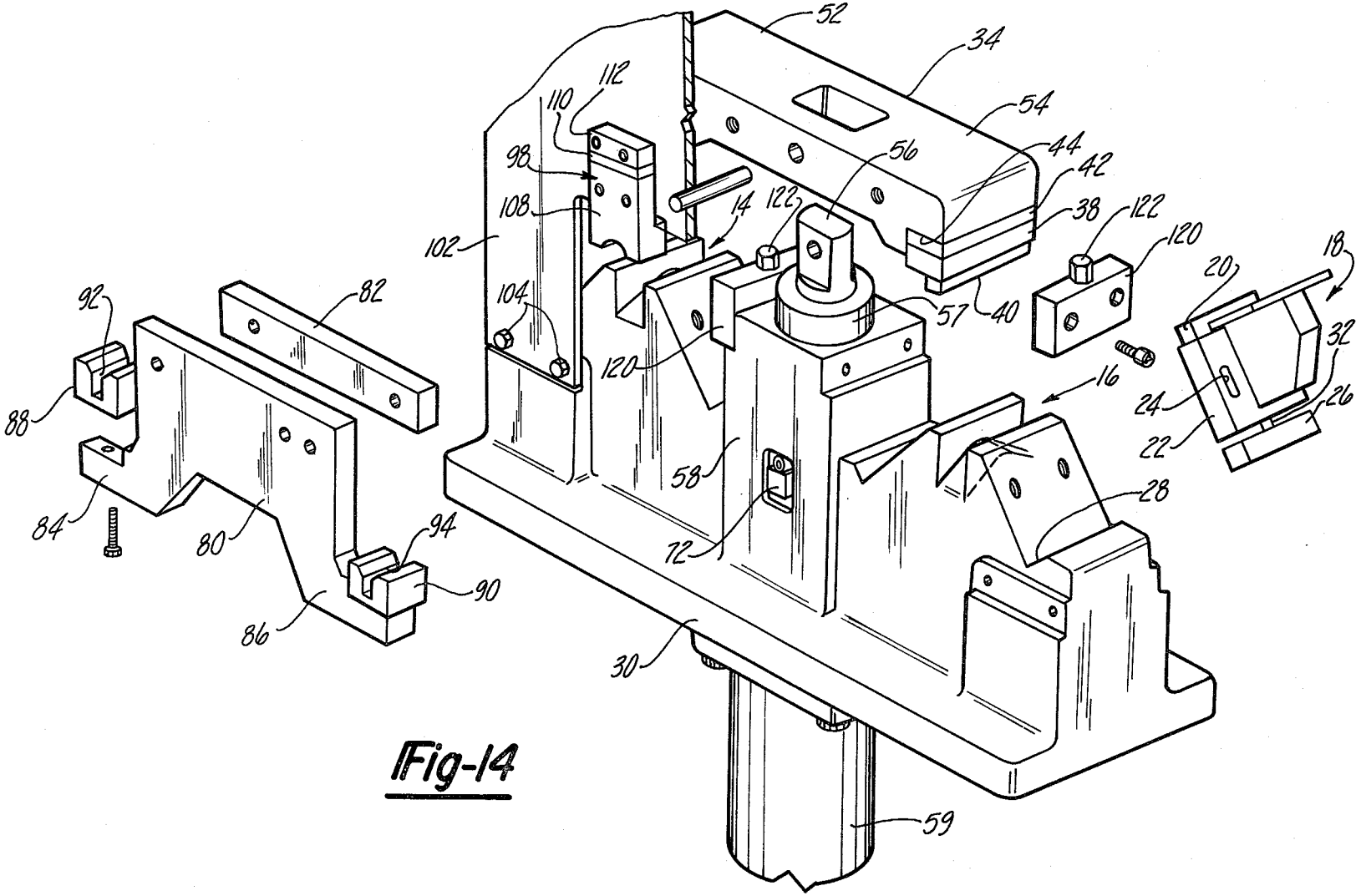
FIG. 14 is an exploded perspective view of portions of the fixture of the preferred embodiment.

A tap clamp bracket 80 is mounted to the front face of head 34 through spacer 82 as can be seen most clearly in FIGS. 7 and 14. Bracket 80 includes two leg portions 84 and 86 onto which tap clamps 88 and 90 are connected, respectively. As can be seen most clearly in FIG. 1, tap clamp members 88 and 90 are in vertical alignment beneath the horizontal center line of work stations 14 and 16, respectively. Additionally, as can be seen in FIGS. 2 and 8-13, the tap clamp members are disposed slightly outwardly or outboard from the work stations as a result of its mounting arrangement to head 34 via bracket 80 and spacer 82. As will become apparent, the purpose of tap clamps 88 and 90 is to grasp the lower portion of a tap protruding through the workpiece. Consequently, tap clamp 88 and 90 may include a semicircular output in their upper surfaces to generally conform to the circular cross-section of the tap. Additionally, slots 92 and 94 may be provided, if necessary, to prevent intererence with a stripper finger for removing the workpiece as will appear later herein.

Figure 6:
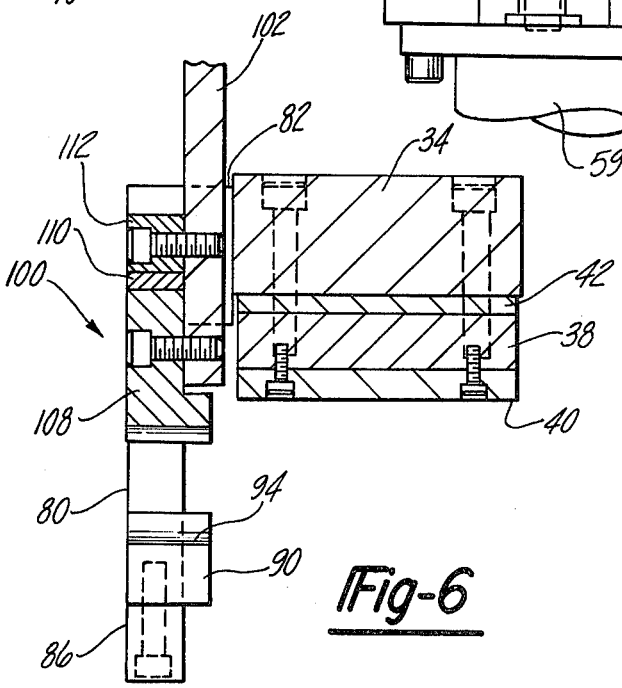
FIG. 6 is a partial cross-sectional view taken along the lines 6—6 of FIG. 1.

The upper tap clamp, i.e. the member for engaging the upper portion of the tap, is provided by way of the construction generally labeled by the reference numerals 98 and 100. Upper tap clamps 98 and 100 are stationary, unlike lower tap clamps 88 and 90 which move with head 34. As can be seen most clearly in FIGS. 1, 6 and 14, each of the upper tap clamps are mounted to a face plate or yoke 102 mounted via bolts 104 to the front portion of base 30. Upper tap clamps 98 and 100 are connected to yoke 102 so that they are each vertically aligned above the horizontal center line of their respective work stations 14 and 16, i.e. directly above lower tap clamps 88 and 90. Each of the upper tap clamp members include a lower block 108, a spacer 110 and upper block 112. The lower surface of block 108 may include a semicircular cutout similar to that of the lower tap clamps.

Figure 4:
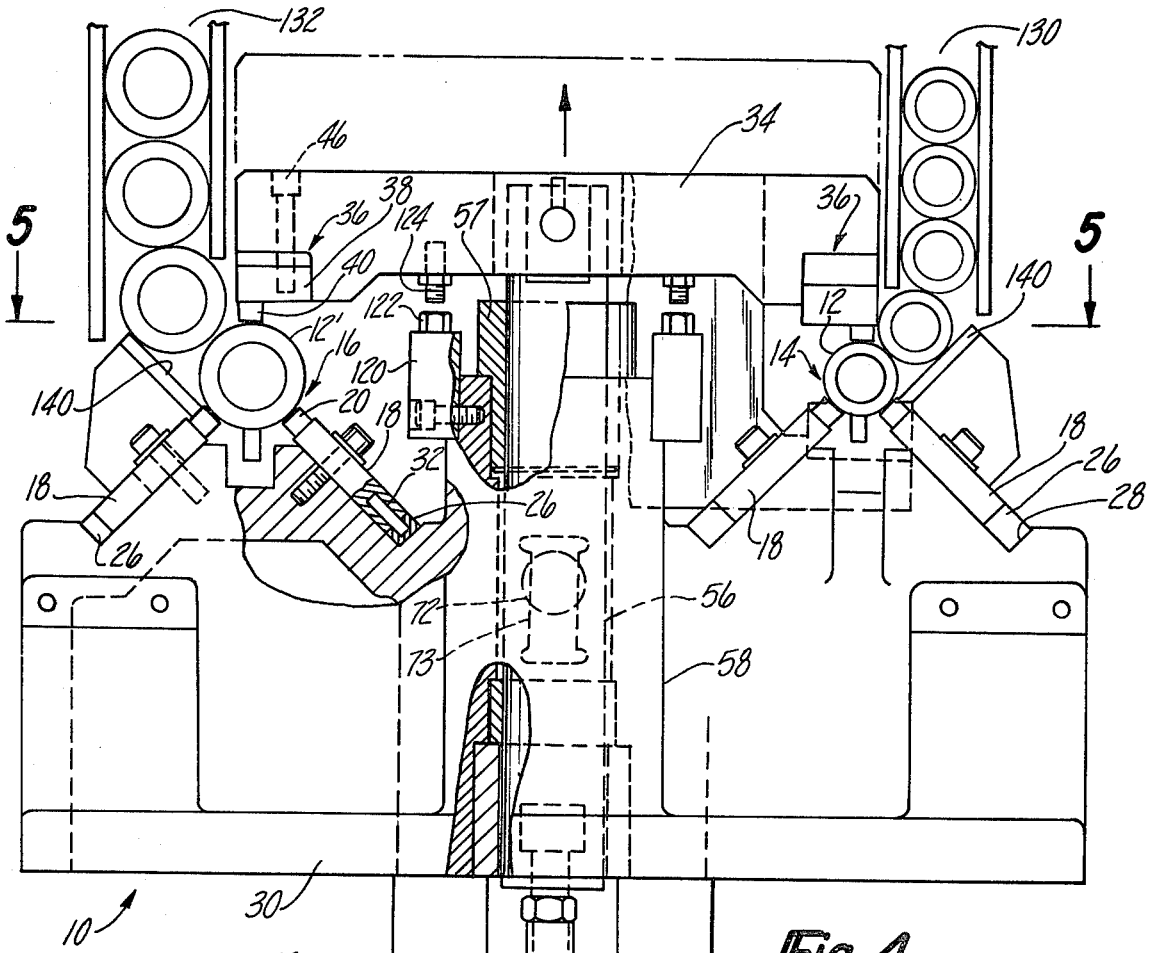
FIG. 4 is a rear elevation view of the movable head portion of the fixture stations along the lines 4—4 of FIG. 2.

Stop blocks 120 mounted on shoulders on either side of cylinder 56 employ buttons 122 to engage bolt shanks 124 to limit the extent of downward motion of head 34 (see, especially FIG. 4). The purpose of this function will become apparent later herein.

Vertical chutes 130 and 132 serve to hold a stack of tubes 12 in a side-to-side or O.D. to O.D. relationship as can be seen most clearly in FIG. 4. Chutes 130, 132 may employ adjustable side walls to accomodate tubes of different sizes. The outlets of chutes 130 and 132 empty into work stations 14 and 16, respectively. In the preferred embodiment the outer contact members 18 include guide plates 140 for steering the tubes into the work stations. It is important to note that the chute outlets for the tubes are adjacent the sides of the movable head 34. As can be seen most clearly in FIG. 4, the relative position of head 34 will determine the feed of the tubes from the chutes. For example, when the head 34 is in the position shown in FIG. 4 no feed of the tubes would be permitted even if the work stations were empty since the sides of the head block the chute outlets thereby impeding the gravity feed of the parts. However, when the head 34 moves upwardly to the position shown by the dotted line in FIG. 4, then the chute outlets will not be blocked permitting the next tube in line to roll into position in its respective work station.

FIG. 1 illustrates one particularly advantageous method of feeding tubes on a conveyor into each of the chutes 130 and 132. In some instances it may be more economically practical to use a conveyor 150 which transports the tubes in an end-to-end relationship from a supply source (not shown) to the position shown in FIG. 1 generally centrally located above and between the inlets to chutes 130 and 132. Pursuant to one aspect of this invention a rocker arm assembly 152 is employed to alternately knock one of the tubes 12 off of conveyor 150 and onto ramps 154 and 156 leading into chutes 130 and 132, respectively.

Rocker arm assembly 152 employs a pendulum 160 pivoted about point 161. A vertically extending strut 172 is connected to bracket 80 (which is connected to head 34). A cross bar 166 rigidly connected to pendulum 160 at one end includes a pin 168 near its opposite end riding in a slot 170 in strut 172. A solenoid 162 employs a movable plunger finger 163 to selectively engage upper portions of the pendulum 160 and thereby prevent it from swinging leftwardly under the action of spring 164.

When head 34 rises to an unclamp position to let new parts enter the work stations the vertical strut 172 lifts cross bar 166 causing pendulum 160 to swing from left to right. This knocks off a tube 12 from conveyor 150 onto ramp 156 where it rolls into chute 132. When pendulum 160 has completed its swing to the right the solenoid finger 163 engages the upper portion of pendulum 160. Consequently, when head 34 later drops to clamp the new parts, strut 172 moves with it but pin 168 merely rides in slot 170 and the finger 163 does not let the pendulum return to its start position. However, when the next tube is moved to its proper position on conveyor 150 the solenoid 162 is energized to retract finger 163 (as shown by the arrow) allowing spring 164 to pull pendulum 160 to the left. This knocks the new tube onto ramp 154 where it rolls into chute 130. It will be appreciated that since the rocker arm assembly 152 is controlled in part by the movement of head 34 once each operational cycle that the feed rate into the chutes will be commensurate with the work output rate of the fixture.

It should be understood that the tubes to be tapped could alternately be fed into the chute inlets by a conveyor which transports the tubes in an O.D. to O.D. manner, e.g. by rolling them along guideways (not shown).

Fixture 10 is designed for use as part of a machine system with a dual spindle tapping unit, i.e. a machine employing two rotating taps capable of simultaneously threading parts in the two work stations 14 and 16. FIGS. 8–13 illustrate one of the two tapping units which are used. The two tapping units are mounted to a common reciprocating carriage structure 202 which moves the tapping units horizontally to and from the rear of the fixture 10. Tapping unit 200 includes a conventional thread forming tap 204 for forming threads in the internal surfaces of the tubes 12 by a non-cutting or thread forming process. Thread forming taps typically take the form of a rod having threads formed in one end thereof and a shank portion at the other end thereof for engaging a tool holder 206 such as a conventional quick change floating holder. Tool holder 206 includes a quick change collet 207 for engaging the shank portion of the tap 204 and imparting rotational movement thereto. A tool releasing mechanism 208 having a forked end serves to push collet 207 under the control of hydraulic cylinder 212 to release tap 204 from tool holder 206.

Pursuant to a feature of this invention, each tapping unit 200 includes a stripper finger 214 disposed below and in alignment with tap 204. Stripper finger 214 is preferably made of a suitable rugged but resilient material capable of bending somewhat. The stripper finger 214 is connected with tapping uint 200 so that it moves in unison therewith. This is accomplished in the preferred embodiment by mounting one end of finger 214 to carriage 202. The transverse thickness of finger 214 beneath tap 204 is less than the diameter of tap 204. Referring especially to FIG. 14, the floating end of stripper finger 214 will pass partially through the slots 92 and 94 in the lower tap clamp members 88, 90 when the tapping unit is in a full forward position. Thus, the thickness of finger 214 should be smaller than the diameter of the tap but it should be thick enough to provide sufficient strength for its intended purpose.

OPERATIONS

The operation of the present invention will be described in connection with reference to the drawings, especially FIGS. 8–13 which have been simplified somewhat to aid in the understanding of the operational sequences. It should be understood that while the drawings and some of the following description refers to only one part that two tubes are actually being simultaneously tapped.

Assuming that the chutes 130 and 132 have some tubes 12, 12' in them, the first step is to apply fluid from a source (not shown) to one side of cylinder 59 to raise the head 34 to an unclamp position as denoted by the dotted lines in FIG. 4. Conventional hydraulic valving arrangements may be used to accomplish the cylinder 59 actuation. Suffice it to say that it would typically include a two way valving arrangement to provide either pressurized fluid or exhaust port communication to various sides of the cylinder head. The valving arrangement may be controlled by the limit switches 66, 68 and 70 of FIG. 1. In the position just described, the dog 60 will have contacted the "unclamp" limit switch 66 to thereby signal to the valve to cease further upward movement of the cylinder. The upward movement of cylinder 59 displaces the sides of head 34 from the chute outlets. This lets the lowermost tubes in the chutes 130, 132 to roll into their respective work stations 14, 16.

Figure 8:
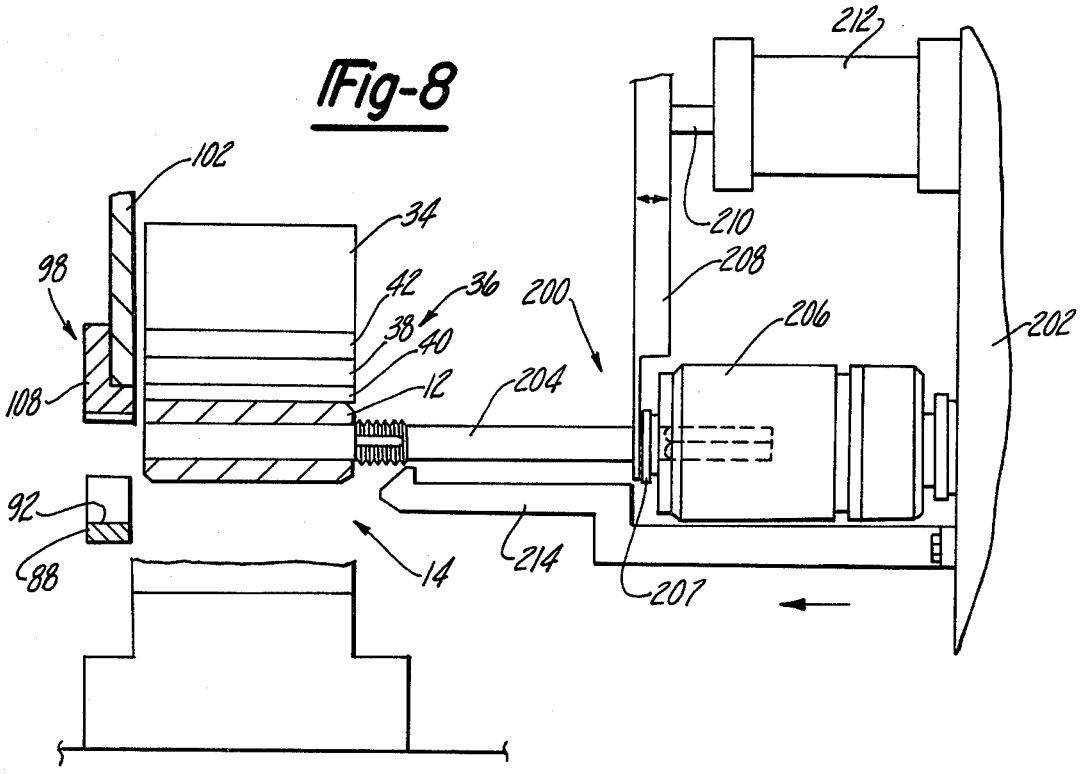
FIGS. 8-13 illustrate the sequence of steps in carrying out the method of the present invention as viewed from the side of the fixture.

As shown in FIG. 8 the next step is for the cylinder to carry head 34 downwardly to the "clamp part" position. This brings the upper contact member 36 for each work station into abutment with its respective tube. Accordingly, the tubes in each of the work stations are securely held in place by three spaced point contacts located about the periphery of the tubes. Note, in particular, that the gripping area for each of the work stations can be easily redefined by using spacers 26, 42 of different sizes.

Figure 9:
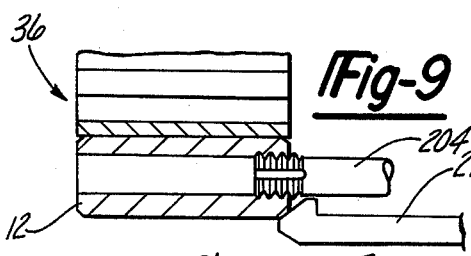
Figure 10:
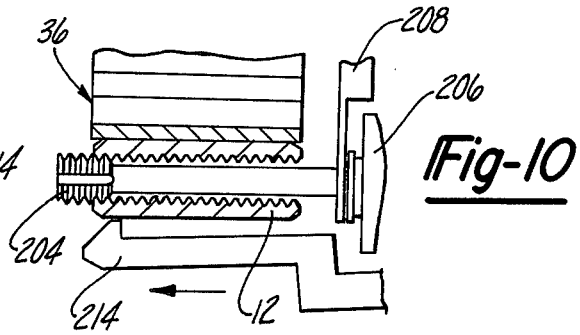

The next step is to advance the tapping unit 200 so that the taps 204 begin to form threads in the tubes as shown in FIG. 9. Note that the inclined surface on the nose of finger 214 acts as a ramp to urge finger 214 downwardly over the lower outer surface of tube 12 as the tapping unit 200 is advanced further as shown in FIG. 10. The forward advancement of the tapping unit 200 is continued until the end of the tap 204 protrudes completely through tube 12 thereby finishing the thread forming process.

Figure 11:
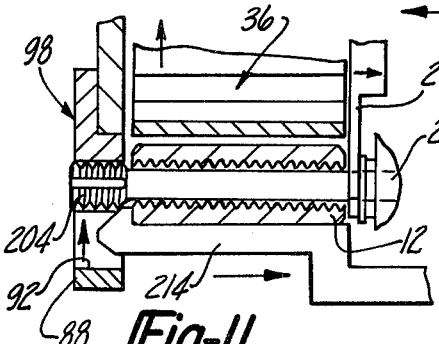

The next step is for the head 34 to move upwardly to a "clamp tap" position carrying lower tap clamps 88 and 90 into contact with the tap 204 as can be seen in FIG. 11. Note that the upper tap clamps 98, 100 remain stationary. The movement of head 34 upwardly removes the upper contact member 36 from the tube 12, but carries the lower tap clamp member 88 into engagement with tap 204 to clamp it against the upper tap clamp member 98. Note that when the tapping unit 200 is fully advanced the end of finger 214 has clipped over the outboard edge of tube 12. Slot 92 in lower tap clamp member 88 provides sufficient clearance for the end of the finger 214. The hydraulic cylinder 212 is then actuated to push tool releasing mechanism 208 against collet 207 thereby disengaging tap 204 from tool holder 206. It is envisioned that the hydraulic cylinder 212 may be eliminated by an appropriately designed linkage mechanism coupling the head 34 to releasing mechanism 208. The linkage mechanism would operate to move mechanism 208 in response to the movement of head 34 to the clamp tap position. In such manner, the tap 204 would be automatically disengaged from tool holder 206 eliminating the need for separate components to accomplish this function.

In any event, at this time the tap 204 is clamped at one end and its other end has been disengaged from tool holder 206. The next step as illustrated in FIG. 12 is to retract the tapping unit 200 by moving carriage 202 rightwardly as shown in the drawings. The retraction of unit 200 will cause stripper finger 214 to pull the tapped tube 12 out of the work station 14 until it completely passes beyond the end of tap 204 at which time the tube will fall off of finger 214 into a container or other conveyor (not shown). Note that the threaded tube 12 is supported by finger 214 during removal over the shank of tap 204. Consequently, the threads are prevented from being damaged as may be the case if the tube 12 was supported solely by the tap 204 during removal in which case the threads could be scraped.

Turning now to FIG. 13, the tapping unit 200 is then readvanced in the forward direction to reengage tap 204. Cylinder 212 causes mechanism 208 to cease pressure on collet 207 so it may again hold the tap within tool holder 206. Then, the head 34 is moved downwardly by activation of cylinder 59 until the stop block buttons 122 engage bolts 124 (FIG. 4). Those skilled in the art will realize that cylinder 59 is designed to merely stall once the stops are encountered and will not damage any of the components. This is well within the skill of an ordinary practitioner. The relative spacing between these two stop members is designed so that the lower tap clamp 88 will become disengaged from tap 204. However, the stops prevent the upper contact members 36 of head 34 to move downwardly to such an extent that it would impede the removal of tap 204 from the work stations. The limitation of this downward movement of the head could be accomplished by way of another dog/limit switch combination and appropriate valving controls. However, the use of the stops as described above simplify the construction a good deal.

Tap 204 is then removed by retracting the tapping unit to the home position as shown in FIG. 8.

Now the machine is ready for the next operational cycle by raising head 34 to the full open or unclamp position allowing the next two tubes to roll into their respective work stations. Note in FIGS. 12–13 the previous positions of head 34 relative to the outlets of the two chutes prevents the entry of new parts into the work stations even though the workpieces have been removed. It is only when the machine is ready for tapping that the tubes are allowed to be fed into the work stations.

Those skilled in the art should now be able to appreciate that the present invention has significant advantages. The fixture 10 is capable of holding multiple parts of different sizes for simultaneously tapping but with very few modifications to the fixture. The fixture accepts parts which may be conveyed in side-to-side (O.D. to O.D.) relationship as well as in an end-to-end manner. Consequently, a variety of parts conveyor techniques may be used.

The system design of the disclosed embodiment is truly synergistic for only one drive cylinder controls several different operations: part feeding, part clamping, tap clamping, and tap unclamping. As noted in the background of the specification, some prior art machines require at least three different drive sources to accomplish these functions. Furthermore, quality parts may be produced at relatively fast production rates using a minimum number of individual components thereby further increasing the system reliability by minimizing the number of parts that could potentially go bad. Those skilled in the art will come to recognize the efficiency of the method and apparatus of the present invention and that further modifications are possible without departing from its spirit after a study of the specification, drawings and following claims.

I claim:

1. A fixture (10) for forming internal threads in a tube (12) by a non-cutting process using a tap (204) removably connected to a tapping unit, said fixture comprising:

a movable head (34) carrying both a tube clamp member (36) and a tap clamp member (88) for clamping said tube (12) and tap (204), respectively, at various positions of the movable head (34) relative to a work station (14) for supporting the tube (12) during the thread forming process.

2. The fixture of claim 1 which further comprises:

a vertical chute (130) having an outlet of a given size of emptying tubes (12) stacked in said chute into said work station (14); and wherein a portion of said head (34) is positioned adjacent to the outlet to selectively control the feed of the tubes (12) into the work station (14) as a function of the position of the movable head (34).

3. The fixture of claim 2 which further comprises:

a single cylinder (59) for moving said head (34) to various positions during the thread forming process whereby the feeding of the tubes, clamping of the tubes and clamping of said tap is provided by one power source.

4. The fixture of claim 1 which further comprises:

a plurality of work stations (14, 16) for supporting a plurality of tubes (12, 12') for simultaneously threading, and wherein said head (34) includes a plurality of tube clamp members (36) and a tap clamp members (88, 90) one for each of said work stations.

5. A machine system for internally threading a tube by a non-cutting process, said system comprising:

a fixture having at least one work station (14) for supporting lower portions of said tube (12);

a vertically movable fixture head (34) having tube clamp means (36) for contacting upper portions of said tube (12) in the work station (14) when the head (34) is at a given position, said head (34) further carrying a lower tap clamp (88) outboard of said work station (14) for contacting an end of a tap (204) protruding through the tube (12);

an upper tap clamp (98) outboard of said work station (14) opposite from said lower tap clamp (88);

a horizontally movable tapping unit (200) with a removable tap (204) therein for forming internal threads in said tube (12);

a stripper finger (214) connected to said tapping unit (200) and adapted to contact an outer edge of said tube when the tap (204) has passed through the tube (12);

means (208) for disconnecting the tap (204) from the tapping unit (200); and motive means (59) for downwardly moving said head (34) to bring said tube clamp means (36) into engagement with the tube (12) to secure it in the work station (12) until the tap (204) has passed through the tube (12) to form internal threads therein, said motive means being further operative to move said head (34) upwardly to clamp the end of the tap (204) protruding through the tube (12) between said upper (98) and lower tap (88) clamps after being disconnected from the tapping unit (200);

whereby said tapping unit (200) may be retracted with said stripper finger (214) pulling the threaded tube (12) from the work station (14) while the tap (204) remains clamped.

6. The system of claim 5 wherein said tubes are sucker rod coupling tubes.

7. The system of claim 5 wherein said tubes (12) are stacked in a vertical chute (130) communicating through an outlet with the work station, portions of said head being adjacent the outlet so that movement of the head (34) selectively blocks the outlet so as to control sequential feeding of each tube into the work station.

8. The system of claim 5 wherein said work station includes two contact members (18) for supporting the lower portions of the tube (12), and replaceable spacers (26, 42) for said contact members (18) and the upper tube clamp means (36) on the head (34) for adjusting the work station clamping area to thereby accomodate tubes of different diameters.

9. The system of claim 5 which further comprises:

dual work stations (14, 16) being fed from two vertical chutes (130, 132) having upper inlets and lower outlets adjacent respective work stations (14, 16) for simultaneously feeding two tubes (12, 12') into the fixture (10) for threading;

a conveyor (150) for conveying unthreaded tubes in an end-to-end relationship to about the middle of the inlets to the two chutes (130, 132); and a reciprocating rocker arm assembly (152) connected to the movable head (34) for alternately pushing said tubes from the conveyor (150) into the inlets of the respective chutes (130, 132).

10. A method of internally threading tubes said method comprising:

stacking said tubes (12) in a vertical chute (130) having an outlet of a given size emptying into a work station (14) for supporting the tubes;

upwardly moving a fixture head (34) located adjacent to the outlet to a first open position to allow one of the tubes (12) to roll into the work station (14), said head carrying an upper tube clamp member (36);

downwardly moving said fixture head (34) to contact the tube (12) with the upper clamp member (36) to hold it securely in the work station (14);

threading the internal surface of the tube (12) by advancing a forming tap (204) connected to a horizontally movable tapping unit (200) through the tube (12) until the end of the tap (204) protrudes through the tube (12);

disconnecting the tap (204) from the unit (200);

moving the head (34) upwardly to clamp the end of the tap (204) between a fixed upper tap clamp (98) and a lower tap clamp (88) carried by the head (34);

removing the threaded tube (12) from the work station (14) by retracting the tapping unit (200) and pulling the tube over the unclamped end of the tap (204) with a stripper finger (124) connected to the unit (200);

readvancing the unit (200) to retrieve the tap (204);

moving the head (34) downwardly to carry the lower tap clamp (88) to a position sufficient to unclamp the end of the tap (204) but not so far as to impede removal of the tap (204) from the work station (14) by the upper tube clamp (36);

retracting the unit (200) to remove the tap (204) from the work station (14); and moving the head (34) upwardly to allow the next tube (12) in the chute (130) to roll into the work station (14) for threading.

11. The method of claim 10 wherein feeding of the tubes into the work station (14), clamping the tubes in the work station (14), and clamping the tap (204) is accomplished by a single cylinder (59) driving said head (34).

12. The method of claim 11 wherein the tubes are sucker rod coupling tubes.

13. The method of claim 12 wherein two tubes (12, 12') are simultaneously threaded in dual work stations (14, 16) using corresponding process steps.

14. A machine system for threading sucker rod coupling tubes, said system comprising:

a fixture (10) including a base (30) through which a movable shaft (56) driven by a cylinder (59) vertically extends through central portions thereof; means (18) on the base (30) defining two work stations (14, 16) one on each side of the shaft (56); a head (34) connected to the shaft (56) and having two arm portions (52, 54) extending over said work stations (14, 16) providing upper tube clamp members (36) for each station; a pair of vertical chutes (130, 132) each having outlets adjacent said arms (52, 54) of the head (34) for feeding tubes into said work stations (14, 16); a bracket (80) mounted to front portions of said head (34) and being configured so as to provide two lower tap clamps (88, 90) in vertical alignment below and outboard of each work station (14, 16); a pair of stationary upper tap clamps (98, 100) in vertical alignment above said lower tap clamps (88, 90); and a horizontally movable dual tapping unit (200) having two taps (204) for simultaneously threading tubes (12, 12') contained in the two work stations (14, 16); a stripper finger (214) under each tap (204) and mounted for movement in unison with the tapping unit (200);

whereby movement of said head (34) by the shaft (56) automatically controls feeding of the tubes (12, 12') into the work stations (14, 16), clamping of said tubes with the upper tube clamps (36) during threading thereof; and clamping of said tap (204) by said upper (98, 100) and lower (88, 90) tap clamps when the threaded tubes (12, 12') are removed from the work stations (14, 16) by the stripper fingers (214) during retraction of the tapping unit (200).

15. The machine system of claim 14 further comprising:

spacer means (26, 42) for adjusting the gripping area of contact members (20, 40) in each work station (14, 16) to thererby accomodate tubes with different diameters.

16. Apparatus (152) for feeding tubes (12, 12') into two spaced chutes (130, 132) communicating with work stations (14, 16) in a fixture (10) having a movable head (34), said apparatus comprising:

a conveyor (150) disposed between upper portions of said chutes (130, 132) for holding a plurality of tubes in an end-to-end relationship;

a rocker arm assembly (152) having a swinging member (160) for sequentially knocking the tubes off of the conveyor (150) and into said chutes (130, 132); and means (172) coupled between the head (34) and the member (160) for controlling the swinging thereof as a function of movement of the head.

* * * * *